United States Patent [19]

Reuter et al.

[11] 4,060,710

[45] Nov. 29, 1977

[54] RIGID ELECTRIC SURFACE HEATING ELEMENT

[75] Inventors: Franz Gottfried Reuter, Lemforde; Tankred Walter Menzel, Bad Essen, both of Germany

[73] Assignee: Reuter Maschinen-and Werkzeugbau GmbH, Lemforde, Germany

[21] Appl. No.: 504,192

[22] Filed: Sept. 9, 1974

Related U.S. Application Data

[62] Division of Ser. No. 292,321, Sept. 26, 1972, abandoned.

[30] Foreign Application Priority Data

| | | |
|---|---|---|
| Sept. 27, 1971 | Germany | 2148191 |
| Oct. 16, 1971 | Germany | 2151626 |
| July 12, 1972 | Germany | 2234216 |

[51] Int. Cl.[2] ..... H05B 3/22; H01B 1/06; H01C 1/012; F24D 13/02

[52] U.S. Cl. ..... 219/548; 29/611; 219/345; 219/528; 219/531; 252/511; 338/212; 338/214

[58] Field of Search ..... 219/213, 528, 535, 543, 219/549, 345, 544, 548, 552, 531, 460; 338/210–214, 306–314; 156/55; 117/216; 252/511, 510; 29/611, 612, 620, 621

[56] References Cited

U.S. PATENT DOCUMENTS

| | | | |
|---|---|---|---|
| 1,422,130 | 7/1922 | Reynolds | 338/308 |
| 2,688,070 | 8/1954 | Freedlander | 219/528 |
| 2,803,566 | 8/1957 | Smith-Johannsen | 117/216 |
| 2,859 ,322 | 11/1958 | Glazier et al. | 219/531 X |
| 3,020,379 | 2/1962 | Ludlow et al. | 219/213 X |
| 3,043,943 | 7/1962 | Moot | 219/460 X |
| 3,143,637 | 8/1964 | Rifenbergh | 219/345 |
| 3,172,072 | 3/1965 | Willy | 338/210 |
| 3,179,544 | 4/1965 | Smith-Johannsen | 156/55 |
| 3,238,355 | 3/1966 | Van Eeck | 219/528 |
| 3,277,419 | 10/1966 | Butz | 338/212 X |
| 3,281,579 | 10/1966 | Glicksman | 219/535 |
| 3,328,317 | 6/1967 | McKeand et al. | 252/511 |
| 3,381,115 | 4/1968 | Welch | 219/544 X |
| 3,385,959 | 5/1968 | Ames et al. | 219/549 |
| 3,387,248 | 6/1968 | Rees | 338/211 |
| 3,465,121 | 9/1969 | Clark | 219/213 |
| 3,535,494 | 10/1970 | Armbruster | 219/528 |
| 3,637,975 | 1/1972 | Eilhardt et al. | 219/213 |
| 3,657,516 | 4/1972 | Fujihara | 219/213 |
| 3,694,622 | 9/1972 | Bently | 219/345 |

FOREIGN PATENT DOCUMENTS

| | | | |
|---|---|---|---|
| 812,919 | 5/1969 | Canada | 219/213 |
| 1,531,520 | 5/1968 | France | 219/345 |
| 1,100,113 | 1/1968 | United Kingdom | 219/213 |

*Primary Examiner*—A. Bartis
*Attorney, Agent, or Firm*—Stevens, Davis, Miller & Mosher

[57] ABSTRACT

A rigid electrical heating element having a thin, rigid, electrically insulating, air-impervious layer and a thick, insulating polyurethane layer formed in situ connected to said rigid layer by a conducting film based upon a synthetic resin, electrically conducting particles and potassium silicate or sodium silicate. Electrodes and corresponding electrical connections are mounted on the film after it has been applied by deposition of an aqueous plastic dispersion of said resin particles and silicate material. The silicates being present in the heating film in sufficient quantity to protect the heating film from attack by the starting reaction components of the polyurethane layer. The rigid layer may be a synthetic resin panel having a decorative heat irradiating surface.

7 Claims, 11 Drawing Figures

Fig. 1a
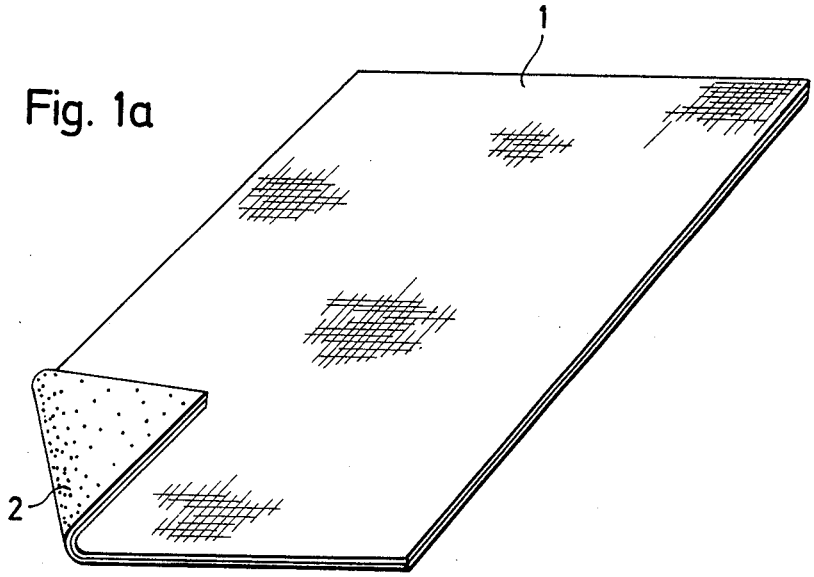
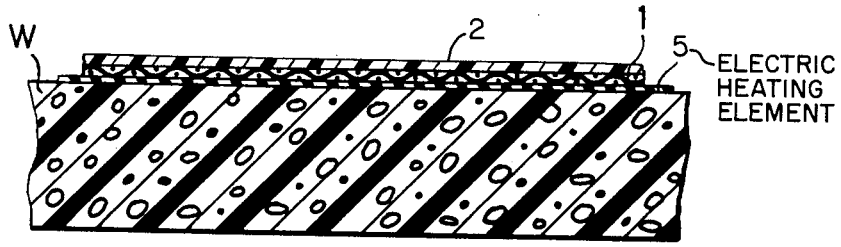
Fig. 1b

RIGID ELECTRIC SURFACE HEATING ELEMENT

This application is a division of U.S. Ser. No. 292,321, filed Sept. 26, 1972, now abandoned.

DETAILED DESCRIPTION OF THE INVENTION

The invention relates to flexible and/or rigid electric area heating elements which, either by virtue of their elastic and flexible properties are intended particularly for pliable electrical heating appliances, e.g. electric cushions, or, by virtue of their outstanding mechanical properties, can be used for example as wall, floor and ceiling heating systems or for heating box-shaped structures or pipes.

In the case of conventionally used electric heat generators electrical energy is converted by so-called resistance wires, following Joule's laws into current heat, the heat produced being passed from the resistance wire through an insulation to the actual heat-irradiating effective surface. These heat conductor wires, which consist for example of nickelin or rheotan and constantan wire, easily break under mechanical strain, by virtue of fatigue phenomena. The disadvantages connected therewith are obvious. It will be understood that pliant heat generators constructed according to this system are sensitive to any kind of mechanical strain and ought not to be described either as pliable, flexible or elastic. For pliable electrical heating appliances, the VDE (Association of German engineers) recommend imprinting the words "do not crease". In general technology, in the household and in medicine, however, elastic, flexible heat generators are desirable, e.g. if complicated contours have to be heated or if compression-bending deflections are required, such as is desirable for example in the case of a heating cushion pad which adapts to the contours of the body. Therefore, there have been various attempts to replace the resistance wires by another material which has substantially better mechanical stability.

Thus it is known to impregnate a flexible carrier material with conductive graphite and for the resultant heating element to be used for heatable bed covers and the like. The carrier material may be inorganic fiber material (British Pat. No. 747,257), organic fabric, for example cotton (U.S. Pat. No. 2,255,376), rubber (German Pat. No. 625,773) or even plastics material (British Pat. No. 671,881).

Where these known heating elements are concerned, the danger of conductor breakage is eliminated above all in the case of organic carriers. Despite this preference, they have not however become established in practice. The reason for this probably resides in the fact that the carrier materials as well as the conductive substances, do not withstand the desired mechanical stresses as soon as traction or compressive forces come into action.

Also known are for example flexible heating elements made from textile fabric, which obtain their conductivity by being coated or impregnated with a graphite dispersion. The term textile fabric in this case denotes a mechanical combination of weft and warp threads. The graphite coating applied to the textile threads by means of a dispersion lies on the weft and warp threads and joins them. This combination is neither flexible nor elastic, so that a slight tractive loading on a single warp or weft thread causes the graphite coating to tear, even if additional binders such as synthetic resins, are intended to enhance the adhesion. If this conductive fabric is then lined with an electrically insulating cover foil, or is otherwise mechanically loaded, then by virtue of the thread movements, the electrical values change to values which cannot be reproduced.

Also known are rigid, electrically heatable area heating elements which are produced by using wires or other woven tissues which are rendered electrically conductive. By virtue of production problems and the fact that the heat irradiation does not correspond to the desired requirements, it has not so far been possible for these area heating elements to become broadly established.

For numerous applications of per se rigid heating elements finally, it is desirable to use a mechanically readily deformable material for the heat-irradiation coating. Such a material is for example advantageous if three-dimensional box-shaped structures or half-shells of tubes have to be heated or are to be constructed as heating elements. Laminated materials would need to be glued if box structures are produced and, furthermore, they have a not completely satisfactory mechanical stressability and resistance to ageing.

The object of the invention therefore was to provide flexible and/or rigid area heating elements which do not exhibit the disadvantages of the prior art and which in particular have a high mechanical and electrical stability as well as reproducable electrical values and improved properties during the heating process. A further object of the invention was to provide a per se rigid area heating element in which the heat transmitting coating consists of a mechanically readily workable, mechanically heavily stressable, highly abrasion-resistant and ageing resistant material and which furthermore conveys heat particularly well and irradiates it to the ambient.

The problem according to the invention is resolved in that an electrically conductive film provided with appropriate electrodes and electrical connections and covered with a relatively thick heat-insulating coating, is applied either onto a unilaterally lined woven fabric or onto a thin heat-resistant rigid heat-irradiating layer.

The object of the invention is thus an electrically heatable area heating element, which consists of a. either a unilaterally lined woven fabric or a thin heat-resistant rigid heat irradiating layer;
b. an electrically conductive film applied to the non-lined side of the woven fabric or to one side of the rigid coating or layer and which is provided with corresponding electrodes and electrical connections, and
c. a thicker heat-insulating coating, preferably a plastics coating, which is applied over the electrically conductive film.

The electrically conductive film hereinafter referred to as the "heating film", of the area heating elements according to the invention is preferably such a film as has been obtained by applying a plastics dispersion which contains electrically conductive particles. The term electrically conductive particles relates preferably to rare metals, other metals or substances coated with rare metal, or carbon, e.g. soot or graphite; soot is particularly preferred. Particularly preferred is an acetylene soot such as is available for example in the form of an aqueous dispersion.

According to a particular embodiment of the area heating element provided by the invention, the thin, heat-resistant, rigid, heat-irradiating layer consists of a metal layer, while the side of the metal layer which is towards the electrically conductive film has an electrical insulating layer or coating.

For the further construction of a heating element according to the invention, at least two electrodes are also required. The purpose of the electrodes is to establish a resistance value between the electrodes which is regular over the entire conductive area. When an electric voltage is applied to the electrodes, then by virtue of the film resistance a homogenous voltage potential forms between the electrodes. The electrodes may be made from flexible metal strip or for example copper-lined plastics foil, so long as the electrodes are not mechanically stressed.

For flexible heating elements such as heatable car seats, heated cushions, heated blankets and the like, a flexible and to a certain extent elastic electrode is required because the heating elements are loaded over their entire area with compression and bending deflections.

In addition to fulfilling these mechanical requirements, the electrodes in both flexible and also rigid area heating elements must have very good electrical conductivity which corresponds approximately to the metal conductors. According to the invention, it has been found that electrodes with elastic and readily conductive properties, such as are manufactured as described hereinafter, are particularly suitable for flexible area heating elements. As a conductive substance, it is not powder from solid silver but powder from silver-plated copper which is used. The powder is commercially available. The particle size is approximately 180 microns. Other metal powders, apart from those coated with precious or rare metals, cannot be used for this purpose. In order to produce the electrodes, a powder of silver-plated copper with a particle diameter of approximately 180 microns, is stirred for example into a 50% aqueous acrylic resin dispersion. Sufficient powder is added for the mixture to be just brushable. Since the relatively large particles of metal powder exhibit, alongside the tangential contact points, relatively large interstices, a 25% aqueous soot dispersion is stirred into the existing mixture. The soot dispersion with 25% readily conductive acetylene soot content (23 millicrons particle diameter) fills the previously unfilled interstices completely with particles of soot once the film-forming carrier liquid has dried off. Thus, the interface resistance of the metal particles is considerably relieved. This is a parallel connection of individual resistances.

According to the thickness, these readily conductive films have a resistance of about 0.1 ohms/sq.cm. and, after a drying time of about 1 hour at room temperature, they exhibit a satisfactory flexible and elastic behaviour.

The thicker heat-insulating coating may consist of any desired homogenous or foamed plastics material which corresponds to the required demands. Preferably, the plastics coating is of polyurethane. In the case of flexible heating elements, this coating particularly consists of a softly elastic polyurethane foam which can be particularly easily foamed directly onto the layer of fabric, while in the case of rigid area heating elements, a layer of rigid polyurethane foam is preferred. The manufacture of the various types of polyurethane foam, soft and hard foams, is known to a man skilled in the art.

Further details of the electrically heatable area heating elements according to the invention will become manifest from the ensuing description, the examples of embodiment and the drawings, in which:

FIG. 1*a* is a perspective view of one embodiment of a textile fabric lined on one side with a plastic lining adapted to be used as a heat irradiating layer in the heating unit provided by the invention;

FIG. 1*b* is a cross-section of one embodiment of a heating unit provided by the invention having the heat-irradiation layer illustrated in FIG. 1*a* combined with a heat insulating layer and a heating element therebetween;

Figure 6:
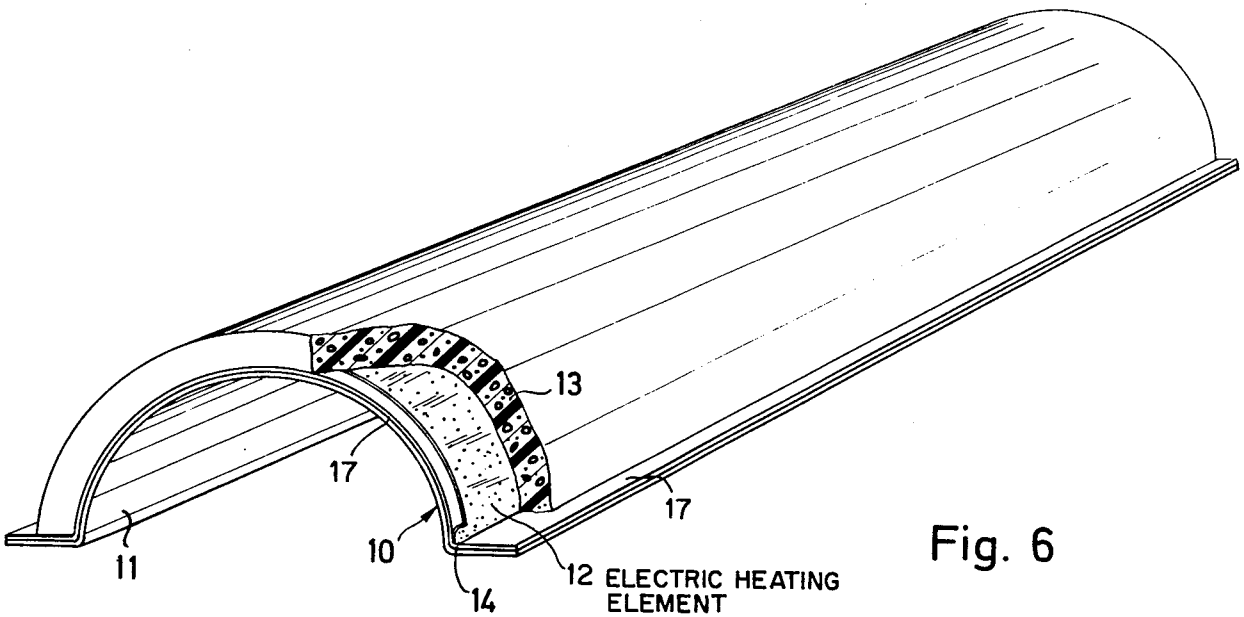
FIG. 6 is a perspective view partially broken away of one-half of a second embodiment of the invention.
Figure 7A:
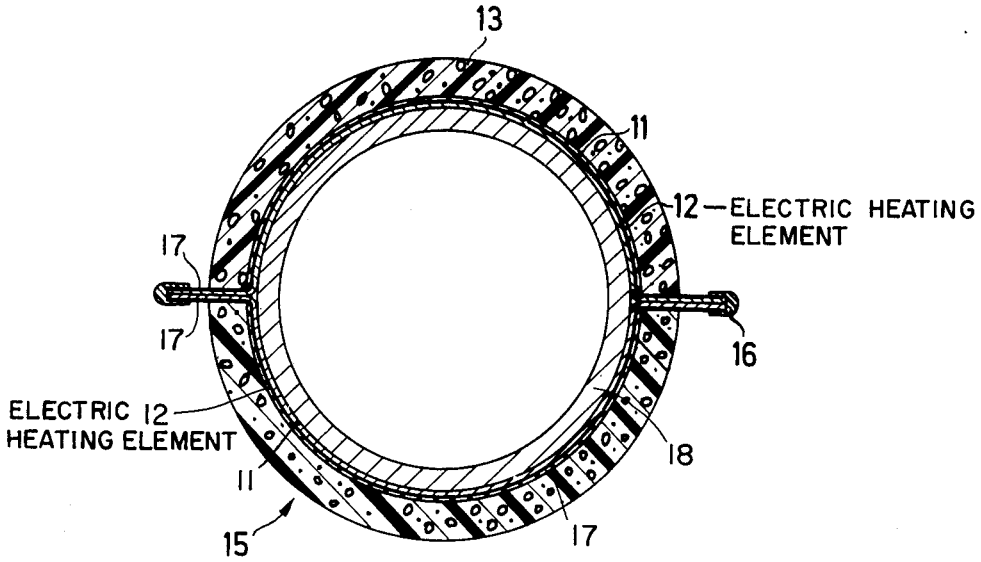
Figure 7B:
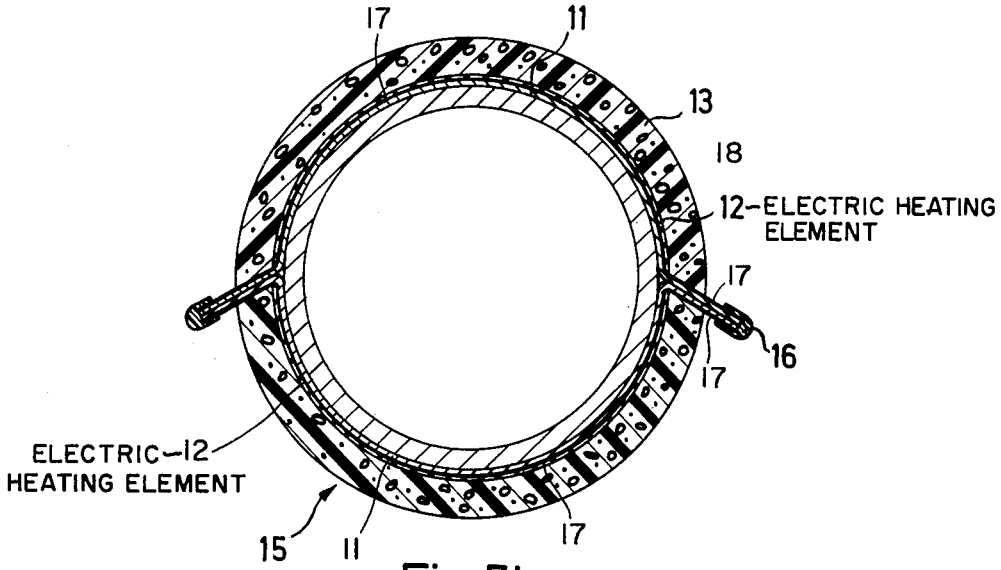

FIG. 7*a* is a cross-section of a second embodiment of the invention prepared by assembling two of the half-shells illustrated in FIG. 6;

FIG. 7*b* is a cross-section illustrating a modification of the embodiment of FIG. 7*a;*

Figure 8:
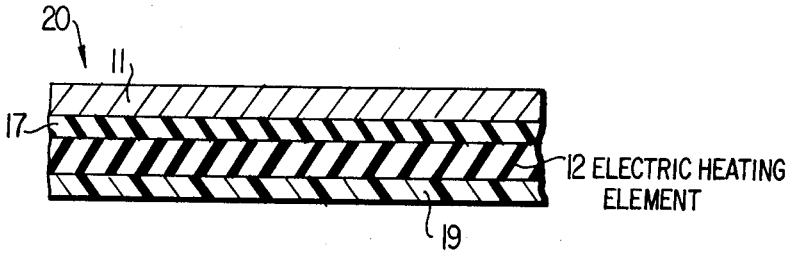
Figure 9:
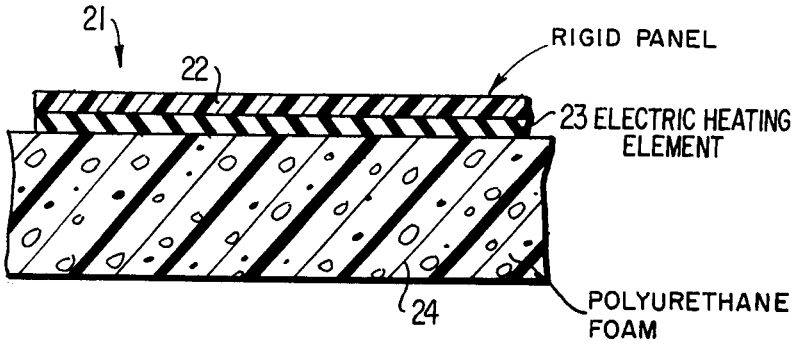

FIG. 8 is a cross-section of yet another embodiment of this invention wherein relatively thin heat-irradiating layer is substituted for the relatively thick heat insulating layer in structures similar in configuration to that shown in FIG. 6; and FIG. 9 is a cross-section of yet another embodiment of this invention employing a rigid heating panel.

Figure 2:
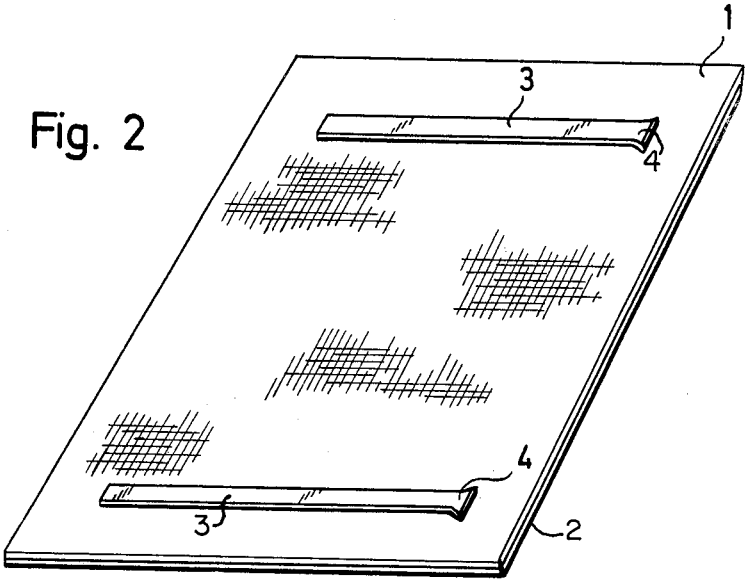
FIG. 2 is a perspective view of the heat irradiating layer of FIG. 1*a* provided with electrodes for use in making a heating unit such as the one illustrated in FIG. 1*b;*
Figure 4:
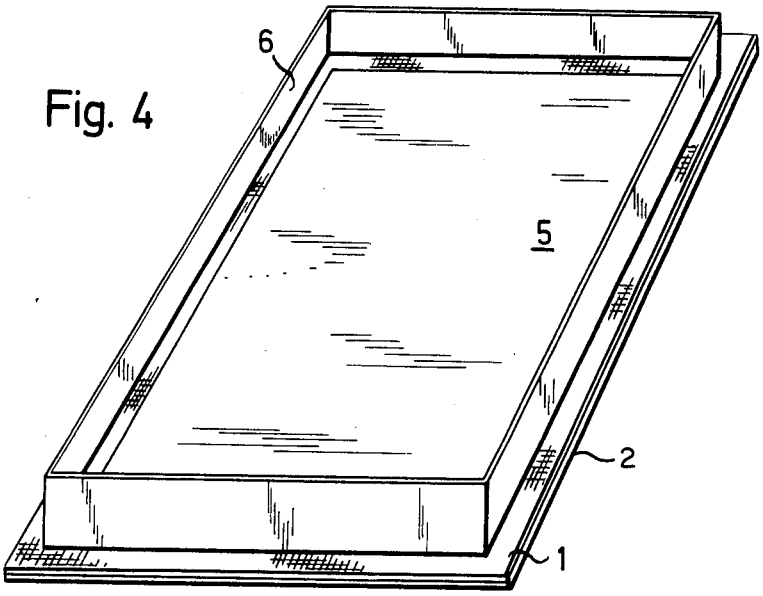
FIG. 4 is a perspective view of an assembly which can be used to mold a heat insulating layer over the surface of the product illustrated in FIG. 3 to produce the product of FIG. 5.
Figure 5:
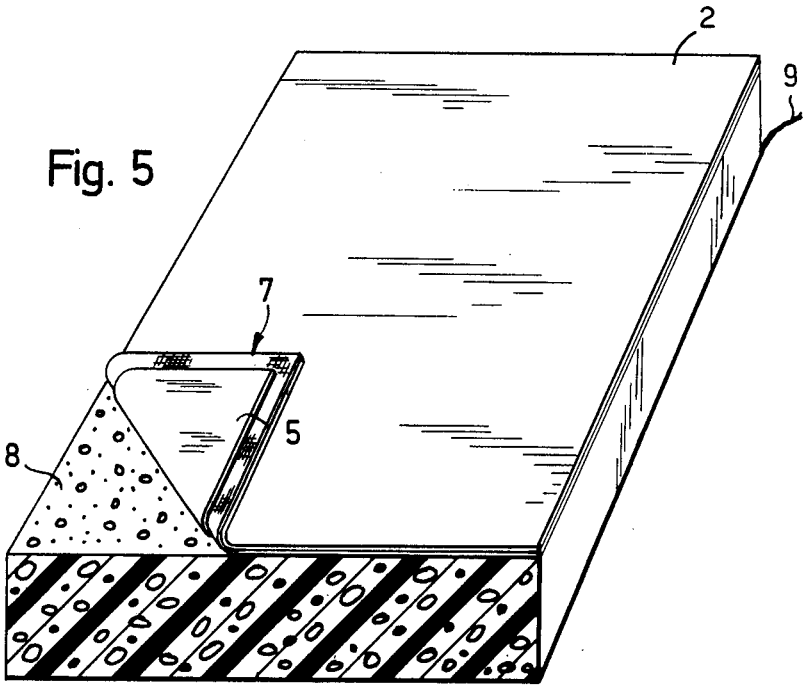
FIG. 5 is a perspective view of the product manufactured as illustrated in FIGS. 1*a,* 2, 3 and it having a thick heat insulating layer and having a portion thereof turned back to better illustrate the components of the heat unit.

One embodiment of the invention employs a heating element having a heat irradiating layer 1 lined with a plastic lining 2 as shown in FIG. 1*a* and is provided with a pair of longitudinally spaced electrodes 3 having electrical contacts 4 as illustrated in FIG. 2. A heating film 5 is then placed over the assembly of FIG. 2 to form the intermediate product illustrated in FIG. 3. Then, a heat insulating layer W is molded over layer 5 using a mold 6 as illustrated in FIG. 4. Heat insulating layer W illustrated in FIG. 1*b* may be a flexible or rigid plastic foam. The embodiment illustrated in FIG. 5 has a heat irradiating layer 7 similar to the one illustrated in FIG. 1*a,* a heating film 5 like that illustrated in FIGS. 1*b* and 3 and a foam padding 8. An electrical conductor 9 connects the electrodes to a source of electricity.

Figure 3:
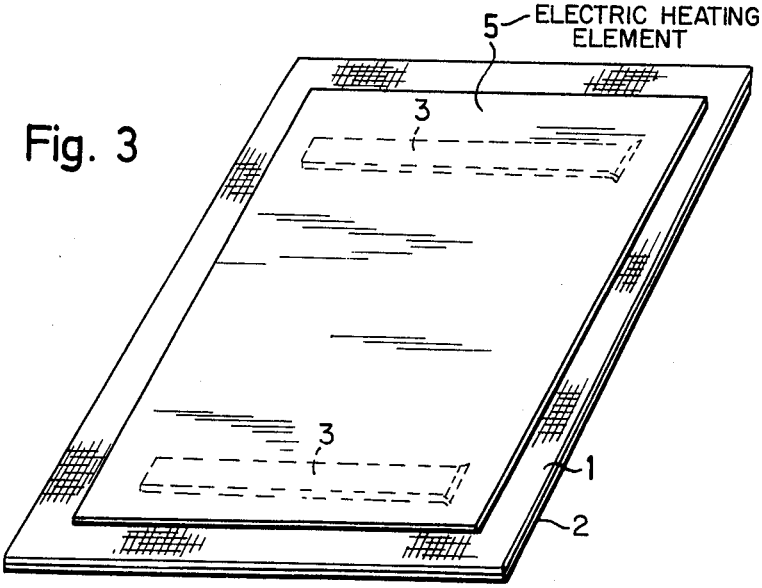
FIG. 3 is a perspective view of the assembly of FIG. 2 after a heating layer has been applied to cover the electrodes.

An area heating structure 10 is illustrated in FIGS. 6, 7*a* and 7*b.* Heating structure 10 has a heat irradiating layer of metal 11, an insulating layer 17, a sprayed on heating film 12 similar to heating element 5 of FIG. 3, a rigid plastic foam layer 13 similar to the foam layer W of FIG. 1*b* and an electrical connection 14 for connecting the half-shell to a source of electricity. Two of the embodiments of the half-shell illustrated in FIG. 6 may be combined to form area heating structure 15 illustrated in FIGS. 7*a* and 7*b.* The embodiment shown in FIG. 7*a* is a pipe 18 having a metal heating element 11 with its flanges fastened together by clips 16. A thin, electrically insulating film is interposed between shell 11 and electric heating element 12, and a rigid foam layer 13 is substantially disposed about the entire structure 15. The embodiment in FIG. 7*b* is similar to that of FIG. 7*a* with the exception that the flanges are disposed at an angle of less than 90° with respect to the longitudinal axis of the area heating structure 15.

An area heating element 20 is illustrated in FIG. 8 which has a similar general configuration to area heating structure 10 of FIG. 6, 7*a*, and 7*b* except that the rigid plastic foam layer 13 is omitted and a relatively thin coating of resin 19 is employed to provide a heat-irradiating layer instead of the thicker heat insulating layer whereby heat can be irradiated to the ambient from both resin layer 19 as well as metal layer 11.

A rigid area heating element 21 is illustrated in FIG. 9 having a decorated rigid panel 22 capable of irradiating heat. Decorated panel 22 is provided with electrodes (not shown) which are similar in configuration to FIG. 2 and electric heating film 23 on the side where there is no design. Then, a relatively thick heat insulating layer 24 is employed so that when heat is generated, it will be irradiated from the surface of the rigid panel. Hereinafter, the flexible embodiment of the area heating element according to the invention will first be described in greater detail.

The fact that the woven fabric used in flexible area heating elements is lined on one side means that the freedom of movement of the individual threads which occurs in conventional area heating elements which have a disadvantage effect for the reasons already stated, is restricted.

For the purpose of the invention, it is possible in principle to use any woven fabrics which are lined on one side, the woven fabric consisting of organic or inorganic materials. Preferably, however, absorbent woven fabrics are used, since when these woven fabrics are treated with the hereinafter described aqueous dispersion, a better adhesion of the heating film which is to be formed can be achieved. The use of non-absorbent woven fabrics is naturally also possible, namely if the heating films which are to be applied adhere sufficiently to the woven fabric. As a textile fabric, it is possible to use fabrics made from natural as well as from synthetic fibres. With regard to the lining, according to the invention, it is particularly those unilaterally lined fabrics wherein the plastics coating is approximately 100 g/sq.m which have proved particularly suitable. According to the invention, particular preference is given to those textile fabrics which are lined on one side with flexible plastics material.

Naturally, when using lined fabrics of woven type, it is possible also to produce rigid heating elements, e.g. wall or ceiling heating systems, when for example a polyurethane rigid foam can be applied to the unlined side of the fabric. For such purposes, the fabric will naturally also be lined with rigid plastics material.

For the manufacture of flexible and elastic wireless area heating elements according to the invention, particularly suitable plastics dispersions which are blended with the electrically conductive particles prior to application onto the woven fabric, are any plastics dispersions which form an elastic ageing resistant film. According to the invention, preferably a 60% aqueous dispersion of polyisobutene is used.

In order to produce the aqueous electrically conductive particle-containing plastics dispersion, an aqueous dispersion of polyisobutene is for example blended with an aqueous dispersion of soot, the viscosity of the plastics dispersion being so adjusted by the blending with the soot dispersion, that a readily brushable mixture is obtained. This mixture is then for example applied to the fabric side of the unilaterally lined textile fabric, i.e. onto the textile fabric which then rapidly absorbs the mixture which forms the film. The film forms within 30 minutes at room temperature. Then the film, according to the thickness of the applied coating, is artifically aged for a few hours at 80° C. The ageing is necessary to stabilise resistance, because the plastics particles previously present in the plastics dispersion, exhibit shrinking due to artificial ageing. The shrinking has the effect that the contact between the conductive particles adhering to the plastics particles becomes somewhat loosened, so that the electrical resistance of the film is somewhat increased. The dispersion forming the heating film consists preferably of an aqueous plastics dispersion which, by the admixture of an aqueous soot dispersion, is adjusted to the desired values with respect to conductivity and workability. A completed film with the heating film applied to the reverse side is flexible and exhibits surprisingly good elastic properties.

In the case of rigid area heating elements with a thin heat-transmitting layer, the thin layer 22 (FIG. 9) may be any flat preferably rigid heat resistant material possibly provided with special designs on the heat-irradiating side. In order to avoid the heating film being affected by outside influences, by atmospheric humidity, the thin layer 22 is preferably impervious to air. As an example for the thin layer 22, the boards available commercially under the trade mark Resopal should be mentioned.

"Resopal" is a trademark for materials which include decorative synthetic resin panels pressed at high pressures and temperatures from a substrate layer of a phenol resin-impregnated soda celluose paper and a top coat of a melamine resin-impregnated high grade sulfite celluose papers to form homogencous panels. See *Chemie-Lexikon,* 6th edition by Hermann Römpp. "Formica" is yet another tradename for similar materials. A preferred method of producing a rigid area heating element according to the invention resides in that, in order to form the heating film, an aqueous plastics dispersion containing the electrically conductive particles is applied onto the thin heat-irradiating layer, the plastics dispersion preferably containing as plastics material an acrylic resin and as electrically conductive particles soot and additionally a potassium or sodium silicate, and after drying of the film, preferably at a temperature of approximately 90° C and with a drying time of approximately 30 minutes, and the application of electrodes and corresponding electrical connections, the thicker heat-insulating coating is applied, preferably a coating of rigid polyurethane foam, whereby, in the case of a rigid polyurethane foam coating, the foam-forming reaction mixture is brought directly into contact with the previously applied heating film.

The viscosity of the plastics dispersion which can be obtained by blending an aqueous acrylic resin dispersion with an aqueous potassium or sodium silicate solution and an aqueous soot dispersion, is expediently so adjusted that a readily brushable mixture is obtained. This mixture is then for example applied to the non-designed side of a Resopal panel.

The use of alkali silicates for such electro-technological uses was not hitherto conventional, because potassium or sodium silicate solutions are not water-resistant and could therefore be destroyed even by atmospheric humidity. Only by virtue of the foaming of the air-impervious rigid polyurethane foams and the use of an air-impervious front panel e.g., a "Formica" panel, according to the invention, has it become possible and expedient to use silicate film. For example, heating films without silicates are subject to marked attack from the rigid foam-forming starting components of the polyurethane, so that the resistance value upon foaming undergoes a 50% change.

The acrylic resin dispersion additionally stirred into the silicate solution and which, exactly like the silicates solution, serves to bond the electrically conductive particles, imparts a certain elasticity to the film. This elasticity is desired because, during heating up within 10 seconds from 20° C to 100° C, substantial differences in temperature and mechanical stresses occur in the system.

It has been demonstrated that a silicate-polymer system is particularly suitable for absorbing such jumps in temperature, so that particularly the conductivity of the heating film is at the moment of starting very favourably influenced. The film of silicate-polymer-soot mixtures is resistant to the aggressive starting components for forming the rigid polyurethane foam, since the foam components are shot directly onto the heating film. The residual humidity on the film (due to polar surfaces) is absorbed by the foam components which contain isocyanate.

In addition to ageing-resistant acrylic resin dispersions, polytetrafluoroethylenes are also very suitable as a synthetic plastic dispersion.

If rigid area heating elements according to the invention are used for floor heating then prefereably before or after they are laid on the floor, with the thicker heat-insulating layer actually lying on the floor, they are provided on the thinner heat-irradiating layer, with a coating of floor-finish which is designed as a heat storage means.

The area heating elements according to the invention, which are preferably lined on the back with a coating of polyurethane foam, are universally usable. In addition to their ready workability into soft and rigid foams, polyurethane materials are particularly characterised by excellent thermal insulating properties. The heating elements according to the invention particularly exhibit three advantages:

1. The heat generated is given off only through the effective area, so that minimal conduction losses result.
2. By virtue of the low heat losses and the construction of the heating area, the heating-up times are very short even in the case of heating elements measuring several square meters in size.
3. By virtue of the fact that the polyurethane reverse side can be soft, springingly elastic or rigid, the construction of heatable padding elements and wall and large-area heating systems is possible in just one operation.

The weight of a one square meter large and 20 mm thick heating area with a coating of polyurethane foam is approximately 1000 g. The heat-irradiating side consists of a material which can be supplied in the most widely diverse designs. In order to eliminate risks caused for example by knocking nails into the heating area, these heating elements preferably operate on low voltages. According to the field of application, so that the heating elements are adjusted to the most widely diverse temperature ranges and can be designed for any working voltages.

If by virtue of poor heat dissipation, an upper temperature limit has to be provided, then a temperature limiting means can be connected directly in or on the heating film circuit.

For heating elements according to the invention, with low working voltages, only the heat-film-forming mixture has to be somewhat modified in that the resistance is reduced according to the desired values by the addition of silver-coated metal powder.

If the heat-irradiating layer of the heating element according to the invention is a metal layer, then it can consist of all manner of metal plates, including galvanised or anodised plates, the metal plates being of any desired thickness.

The electrical insulating layer which in this case is found on that side of the metal layer which is towards the heating film should adhere very rigidly to the metal layer and exhibit a satisfactory bond with the heating film. Furthermore, the insulating layer must consist of a material with a high electrical insulating capacity and a high breakdown voltage.

Preferably, the insulating coating consists of a material resistant to temperatures up to 150° C, particularly a plastics material which does not soften under the effect of heat or which has no other disadvantageous rheological properties, and which does not develop any gases, and which is expediently present in the hardened-out state. Mostly preferred among plastics materials are epoxide resins which have been applied by some powder technology.

Particularly suitable as epoxide resin powders are single-component resins marketed by the 3M Company under the trade names "Scotchkote" and "Resistan". Metal plates coated with epoxide resin can be bent in this state, so that the coating suffers no damage.

Preferably the insulating coating has all over a minimum thickness of approximately 70 $\mu$.

The insulating coating may also be a layer of lacquer or a plastics foil lined onto the metal plate. In the latter case, however, the cut edges are not coated and thus constitute a corrosion problem, whereas in the case of plates coated with powdered epoxide resin, also the cut edges are coated.

A preferred form of embodiment of area heating element according to the invention and of the last-mentioned type takes the form of tubular half-shells which are suitable for the heating of tubes, particularly for maintaining the correct temperature conditions in pipelines. As a heat-insulating layer, these tubular half-shells preferably have a coating of rigid polyurethane foam which permits an almost 100% unilateral transmission of heat to the effective surface. The construction of the area heating element in the form of two separate tubular half-shells permits of easy assembly and removal of the heating system.

According to another modified form of embodiment, the area heating element according to the invention takes the form of a tube, the tube body taking over the role of the metal plate. In the case of this form of embodiment, the heating film is located directly on the tube body which is coated with epoxide resin powder.

The area heating elements according to the invention, which are present in the form of tubular half-shells or tubes are inter alia also suitable as accompanying heating for the transport of oil, and can also be used in chemical plant engineering.

The area heating element according to the invention is completely waterproof and resistant to temperatures down to below −60° C. The area heating element can furthermore be used for working temperatures of up to +90° C. It is mostly arranged for voltages of 12, 24, 42, 60 or 110 volts.

Metal area heating elements are preferably used only for voltages up to 110 volts, since, between the heating film and the plate with the dielectric located in between (electrical insulating coating), a capacitor system builds up which can under certain circumstances result in an electrical breakdown.

A modified area heating element according to the invention has instead of the thicker heat-insulating rigid coating, a thin heat-irradiating coating. This thin coating preferably consists of an epoxide resin. This form of embodiment is particularly applicable if the heat can be irradiated to the ambient on both sides.

Hereinafter, the manufacture of an area heating element according to the invention having a metal layer as a heat-irradiating layer will be explained with reference to an example.

A metal plate is cleaned and then coated on both sides with an epoxide resin powder. The coating can be applied for example by the eddy sinter method, at the spraying method or the electro-static coating process; preference is given to the latter process.

The coated plate is then heated in order to dry out the epoxide resin. Then, electrodes are applied to one side of the coated plate. For low working voltages, e.g. of 12 to 42 volts (current flow above 2 amperes), silver plated or gold-plated copper strips are glued directly onto the layer of epoxide resin. Glues are used which contain no acetone or methyl ethyl ketone. For lower currents, (current flow less than 2 amperes), the electrodes can be produced by application of liquid silver lacquer. The electrical resistance along an electrode ought not to exceed 1 ohm.

Once the electrodes have been applied, the heating film as previously described is applied and dried out at elevated temperature. The heating film ought to overlap both electrodes. Thereupon, the electrodes are connected to connecting wires by means of terminals or by soldering. Finally, the entire system is foamed with rigid polyurethane foam by one of the previously described methods.

If by virtue of some special application of the area heating element, no layer of foam is required, then the heating film, like the electrodes, can also be coated with epoxide resin, in which case an area heating element is obtained which as mentioned, has a thin heat-irradiating layer instead or the thicker heat insulating layer.

In any case, the heating film should be protected against atmospheric influences, for example because the formation of sweated water which occurs can result in creep currents.

The following examples explain the invention without however restricting its scope.

EXAMPLE 1

Manufacture of a flexible heating cushion

A textile fabric 1 (see FIG. 1*a*) lined on one side with plastics material 2 is provided on the unlined side with flexible elastic electrodes 3 (see FIG. 2). The electrodes 3 are applied by means of a template (14 mm wide, 270 mm long) and are at a reciprocal distance of 370 mm. The electrode mixture consists of 80 parts by weight of a 50% dispersion of a copolymer of butyl acrylate, vinyl acetate and acrylic acid, 100 parts by weight of silver-coated copper powder and 100 parts by weight of a 25% acetylene soot dispersion.

Then, using a frame template (270 × 370 mm), the actual heating film 5 is applied (FIG. 3). In order to produce the heating film 5, an aqueous dispersion of polyisobutene is, while being stirred, thoroughly blended with a 25% aqueous acetylene soot dispersion. The easily brushable mixture is evenly applied to the woven fabric. The electrodes are completely covered by the heating film 5. Then, the film 5 is dried. By means of plastics rivets, a contact plate and cable shoe are applied to each electrode in order to allow connection to a voltage supply.

The entire heating heating film can if necessary be sealed with an electrically insulated plastics dispersion.

The formation of a softly elastic polyurethane foam padding on the heating film 5 is now prepared. The polyurethane foam is foamed on in known manner and therefore need not be described in greater detail. A mold frame 6 (FIG. 4), with for example sides 40 mm high, is so placed on the heating foil that on each side of the heating film, the inside of the mold frame is at a minimum distance of 15 mm (see FIG. 4). The reaction mixture forming the foam is poured into the mold space. A mold cover is placed on the mold and pressure applied in order to avoid emergence of the foaming substance.

The mold frame 6 can be removed after 10 minutes. On its reverse side, the heating element now shows the elastic foam pad 8 (see FIG. 5). When a voltage is applied, the heat generated is now radiated only from the lined surface.

EXAMPLE 2

Manufacture of a Resopal-coated heating element

A Resopal or Formica panel 22 in FIG. 9 is first provided with electrodes (not shown in FIG. 9) on the side on which there is no design. The electrodes are applied by means of a template (14 mm wide, 270 mm long) and are at a reciprocal spacing of 370 mm. The electrode mixture consists of 80 parts by weight of a 50% dispersion of a copolymer of butyl acrylate, vinyl acetate and acrylic acid, 100 parts by weight of silver-coated copper powder and 100 parts by weight of a 25% acetylene soot dispersion.

Then, using a frame template, (270 × 370 mm), the actual heating film 23 is applied. In order to produce the heating film, to a mixture of 100 parts by weight of a potassium silicate solution (potassium water-glass, dry substance 30%, water 70%), with a $K_2O : SiO_2$ ratio of 1 : 2.45 and 80 parts by weight of a 25% aqueous soot dispersion, are added 80 parts by weight of 50% aqueous acrylic resin dispersion. The readily brushable mixture is applied evenly to the non-designed side of the Resopal panel. The electrodes are completely covered by the heating film. The film is then dried for approximately 30 minutes at approximately 90° C. A contact plate and a cable shoe are attached to each electrode in order to allow connection to a voltage source.

The entire heating film may if necessary be sealed with an electrically insulating plastics dispersion.

The formation of a rigid polyurethane foam on the heating film is now prepared. The polyurethane foaming material is foamed on in known manner and need not therefore be described in greater detail. The mold frame 6 (FIG. 4) with sides for example 40 mm high, is so placed on the heating film that the inside of the mold frame 6 is at a minimum distance of 15 mm from each side of the heating film. The reaction mixture forming the rigid foam is poured into the space in the mold 6. A cover is placed onto the mold 6 and pressure is applied to it to avoid the foaming-up material emerging.

After removal of the mold frame 6 the heating element has on its reverse side a layer of rigid polyurethane foam 24. The heat generated when a voltage is applied is now irradiated from the surface of the Resopal panel 22.

It goes without saying that also the thicker, heat-insulating layer 8 may first be produced, the conductive film and the electrodes etc. then applied after which the heat-irradiating thin layer can be applied. For example, it is possible first to produce a rigid polyurethane foam panel, provide this on one side with an electrically conductive film and the corresponding connections and then to foam on a thin coating of rigid polyurethane foam to act as a heat irradiating layer.

EXAMPLE 3

Manufacture of a rigid heating element with a metal layer as a heat-irradiating layer An iron plate is cleaned with trichloroethylene and then coated by the electrostatic coating process. The powdered resin is applied in a quantity which is so calculated that the completed layer is approximately 100 microns thick. The coated plate is then heated in an oven to 200° C, the epoxide resin hardening to form an homogenous film.

Then, onto one side of the iron plate, directly onto the epoxide resin coating, silver or gold-plated copper strips are glued to act as electrodes. Then, a heating film of Example 2 is so applied that it overlaps both electrodes. The heating film is then dried for 15 minutes at 80° C.

After the connecting wires have been joined to the electrodes by terminals or by soldering, the entire system is foamed in with rigid polyurethane foam in the manner previously described. A heating structure according to this example is shown in FIGS. 6, *7a* and *7b*.

EXAMPLE 4

Example 3 is repeated with the modification that the heating film and the electrodes are not foamed in but are likewise coated with epoxide resin as shown in FIG. 8. The resin is hardened out by being heated for 6 minutes to 150° C.

We claim:

1. A rigid surface heating element heated by electricity and consisting of a thin, rigid, heat-resistant, electrically insulating, air impervious layer for emitting heat, connected by means of an electrically conducting film provided with corresponding electrodes and electrical connectors to a thicker, rigid, air impervious electrically insulating polyurethane foam layer, said heating element being prepared by mounting said electrodes on said thin, rigid, heat-resistant, electrically insulating, air impervious, heat emitting layer, depositing an aqueous plastic dispersion consisting essentially of a synthetic resin, electrically conducting particles, and an alkai silicate selected from the group consisting of potassium silicate and sodium silicate in an amount sufficient to provide homogeneous voltage potential properties to form said electrically conducting film over said electrodes and heat emitting layer, drying said film, and depositing said thicker, air impervious, heat insulating, polyurethane resin foam layer over the entire surface of said film by bringing a foam-forming reaction mixture into direct contact with the previously deposited electrically conducting film, said silicates being present in said heating film in sufficient quantity to protect said heating film from attack by the starting reaction components of the polyurethane resin.

2. The heating element of claim 1 wherein said electrically conducting particles are selected from the group consisting of precious metals, other metals coated with precious metals, substances coated with precious metals, and carbon.

3. The heating element of claim 2 wherein said carbon is selected from the group consisting of lampblack, soot, and graphite.

4. The heating element of claim 1 wherein said synthetic resin is an acrylic resin.

5. The heating element of claim 1 wherein an airtight synthetic resin layer is used as said thin, rigid, heat resistant, electrically insulating, air impervious, heat emitting layer.

6. The heating element of claim 5 wherein said synthetic resin is "Formica".

7. The heating element of claim 1 wherein said aqueous plastic dispersion comprises a mixture of about 100 parts by weight potassium silicate solution comprising about 30 percent by weight $K_2O:SiO_2$ having a ratio of about 1 to 2.45, about 80 parts by weight of about 25 percent by weight aqueous soot dispersion, and about 80 parts by weight of about 50 percent aqueous acrylic resin dispersion.

* * * * *